US005547023A

United States Patent [19]

McDaniel et al.

[11] Patent Number: 5,547,023

[45] Date of Patent: * Aug. 20, 1996

[54] SAND CONTROL WELL COMPLETION METHODS FOR POORLY CONSOLIDATED FORMATIONS

[75] Inventors: Billy W. McDaniel; Hazim H. Abass, both of Duncan, Okla.

[73] Assignee: Halliburton Company, Duncan, Okla.

[ * ] Notice: The term of this patent shall not extend beyond the expiration date of Pat. No. 5,431,225.

[21] Appl. No.: 451,080

[22] Filed: May 25, 1995

Related U.S. Application Data

[63] Continuation-in-part of Ser. No. 310,174, Sep. 21, 1994, Pat. No. 5,431,225.

[51] Int. Cl.[6] ..... E21B 43/267; E21B 43/27

[52] U.S. Cl. ..... 166/280; 166/50; 166/307; 166/308

[58] Field of Search ..... 166/308, 280, 166/281, 295, 50, 307, 298, 276

[56] References Cited

U.S. PATENT DOCUMENTS

| | | | |
|---|---|---|---|
| 3,020,954 | 2/1962 | Graham et al. | 166/308 X |
| 3,455,388 | 7/1969 | Huitt | 166/308 X |
| 3,835,928 | 9/1974 | Strubhar et al. | 166/308 X |
| 3,929,191 | 12/1975 | Graham et al. | 166/280 X |
| 4,005,750 | 2/1977 | Shuck | 166/308 |
| 4,519,463 | 5/1985 | Schuh | 166/50 X |
| 4,974,675 | 12/1990 | Austin et al. | 166/250 |
| 5,128,390 | 7/1992 | Murphey et al. | 523/130 |
| 5,238,068 | 8/1993 | Fredrickson | 166/307 |
| 5,318,123 | 6/1994 | Venditto et al. | 166/250 |
| 5,431,225 | 7/1995 | Abass et al. | 166/280 |

OTHER PUBLICATIONS

SPE Paper No. 28555 entitled "Oriented Perforations —A Rock Mechanics View" by Hazim H. Abass, David L. Meadows, John L. Brumley, Saeed Hedayati and James J. Venditto, Halliburton Energy Services, to be presented at the SPE Annual Technical Meeting, New Orleans, Louisiana, Sep. 25–28, 1994.

*Primary Examiner*—Stephen J. Novosad

*Attorney, Agent, or Firm*—Craig W. Roddy; C. Clark Dougherty, Jr.

[57] ABSTRACT

Methods of completing poorly consolidated, weak, or otherwise unstable subterranean formations bounded by one or more consolidated formations to prevent well bore stability problems and/or sand production from the poorly consolidated or unstable formations are provided. The methods basically comprise the steps of drilling a well bore into the consolidated boundary formation adjacent to the poorly consolidated or unstable formation, creating at least one flow channel communicating with the well bore in the consolidated boundary formation which extends into the poorly consolidated or unstable formation and producing fluids from the poorly consolidated or unstable formation into the well bore by way of the flow channel.

20 Claims, 3 Drawing Sheets

SAND CONTROL WELL COMPLETION METHODS FOR POORLY CONSOLIDATED FORMATIONS

CROSS REFERENCE TO RELATED APPLICATION

This application is a continuation-in-part of Ser. No. 08/310,174 filed on Sep. 21, 1994 now U.S. Pat. No. 5,431,225.

BACKGROUND OF THE INVENTION

1. Field of the Invention

The present invention relates to well bore drilling techniques and completion methods for use in formations that present well bore stability and/or sand production problems either during the drilling operation and/or after well completion. Poorly consolidated sandstone or carbonate formations, coals, shales, or any formation that is highly stressed or that is reactive to the drilling fluid used would be included in these categories. Additionally, completion methods presented in this invention apply to methods used in completing such wells (whether vertical, horizontal, or inclined well bores) that effectively communicate the well bore with the targeted formation using various techniques including, but not limited to, hydraulic fracturing, oriented or nonoriented perforating, and hydrajetting of holes or slots.

2. Description of the Prior Art

The drilling of well bores in many formations is made more difficult by problems of formation instability. This can be caused by the presence of unusual or high stress within the formation, very low formation strength, or adverse reactions with drilling fluids. Further, the migration of formation particles with fluids produced from soft or poorly consolidated formations has also been a continuous problem. Numerous techniques have been developed to assist in controlling sand production including placing screens and/or gravel packs between the producing formations and the well bores penetrating them, utilizing hardenable resin coated particulate material to form consolidated gravel packs, or contacting the near well portions of poorly consolidated formations with consolidating fluids which subsequently harden. In many wells using these current methods sand production problems have continued. Sand production usually results in lost hydrocarbon production (or injectivity) due to the plugging of gravel packs, screens and perforations as well as production equipment such as flow lines, separators and the like. In some cases the result has been partial or complete well bore collapse, resulting in expensive workover or redrill operations.

When a formation is penetrated by a well bore, the near well bore material making up the formation must support the stress that was previously supported by the removed formation material. In a poorly consolidated rock formation, this stress may overcome the formation strength, causing the formation to breakdown and collapse into the well bore. This can cause loss of communication between the well bore tubular conduits and the remainder of the well bore beyond where such a collapse occurs. Additionally, if there is a high or otherwise unusual stress component in the formation, removal of formation material by the drilling process can cause a localized intensification of the stress field and also cause well bore collapse.

In a weak or poorly consolidated rock formation, this stress overcomes the formation strength which causes the formation to breakdown and sand to migrate into the well bore with produced fluids. As the poorly consolidated formation is produced over time, the breakdown of the formation progresses throughout the reservoir and the production of sand continues.

Thus, there is a need for improved methods of drilling and/or completing a well bore in certain formations and especially in poorly consolidated or highly stressed subterranean formations where well bores may be unstable or where stress induced formation failures during production may bring about sand production or well bore collapse.

SUMMARY OF THE INVENTION

Improved methods of drilling and/or completing poorly consolidated formations which prevent sand production or overcome well bore stability problems are provided by the present invention which meet the need described above and overcome the shortcomings of the previously used drilling or completion methods. The new methods basically comprise the steps of drilling a well bore, preferably a horizontal well bore, into a consolidated (or otherwise stable) boundary formation adjacent to the target producing formation to be completed, and then forming at least one flow channel in the stable boundary formation which communicates with the well bore and extends into the target (poorly consolidated or unstable) formation. Fluids from the target formation are produced into the well bore by way of the flow channel.

The flow channel or channels can be formed in various ways depending upon the proximity of the well bore to the poorly consolidated or unstable producing formation. For example, the flow channel or channels can be formed by the well known stimulation or completion techniques of hydraulic fracturing, fracture acidizing, fluid jetting of slots or holes, directional perforating and the like. The flow channel or channels formed are preferably packed with a highly permeable particulate material (such as graded sand) over their entire lengths whereby stress failures along the flow channels are prevented. In some applications, the use of a particulate that is coated with a curable resin material which can result in the consolidation of this permeable particulate material which can act to further stabilize formation collapse or formation sand production from that zone or other consolidation methods could be used.

When hydraulic fracturing is utilized, the techniques used to accomplish the fracture development and extension may be somewhat different depending upon whether the hydraulic fracture was originating from an open hole well bore, a non-cemented liner, or a cased and cemented well bore.

In one preferred embodiment when the completion occurs in a cased and cemented well bore, the fractures are created by first producing a plurality of directionally oriented perforations in the well bore followed by application of hydraulic pressure to the perforations in an amount sufficient to fracture through the consolidated boundary formation and extend the fracture into the poorly consolidated or unstable target formation. In another embodiment, the directional stress would be known and perforations would be oriented specifically to enhance formation of the most conductive fracture possible.

Thus, it is a general object of the present invention to provide improved well completion methods for formations where well bore stability would be a problem during drilling or during production, and/or for poorly consolidated formations to prevent sand production from the formations. In some instances, this invention may not be a complete replacement for conventional completion methods currently used in poorly consolidated or weak formations, such as well bore gravel pack techniques. Use of this invention in combination with currently used completion methods can significantly reduce drilling and/or production problems.

Other and further objects, features and advantages of the present invention will be readily apparent to those skilled in the art of drilling or completion techniques and/or drilling fluids upon a reading of the description of preferred embodiments (which follows) when taken in conjunction with the accompanying drawings.

DESCRIPTION OF PREFERRED EMBODIMENTS

As mentioned, the methods of the present invention allow a poorly consolidated or otherwise unstable formation to be completed in a manner whereby sand production from the formation is prevented and well bore stability problems are avoided. Such formations that produce hydrocarbons are usually bounded by consolidated formations or more stable formations which are relatively non-productive. The term "poorly consolidated formation" is used herein to mean that the formation is formed of generally friable sand. The term "unstable" is used herein to mean more competent formations than poorly consolidated formations that may also fail and cause well bore stability problems due to high stress in the formation, possibly as a result of producing hydrocarbons from the reservoir. When a well bore is drilled into either of these formation types, a plastic zone develops around the well bore and formation breakdown within the plastic zone is the main source of sand production or formation failure. As formation fluids are produced from the formation, the plastic zone is expanded and sand production (or well bore stability problems) continue or even worsen. The term "consolidated formation" is used herein to mean a rock formation in which the formation has adequate grain strength and/or the in-situ stresses are more nearly in equilibrium whereby stability is not a problem. While the drilling of a well bore in a consolidated formation causes the in-situ stresses to deform around the well bore and a stress concentration zone to be formed, the mechanical properties of the rock making up the formation are such that the stress concentration does not cause formation break down.

Figure 1:
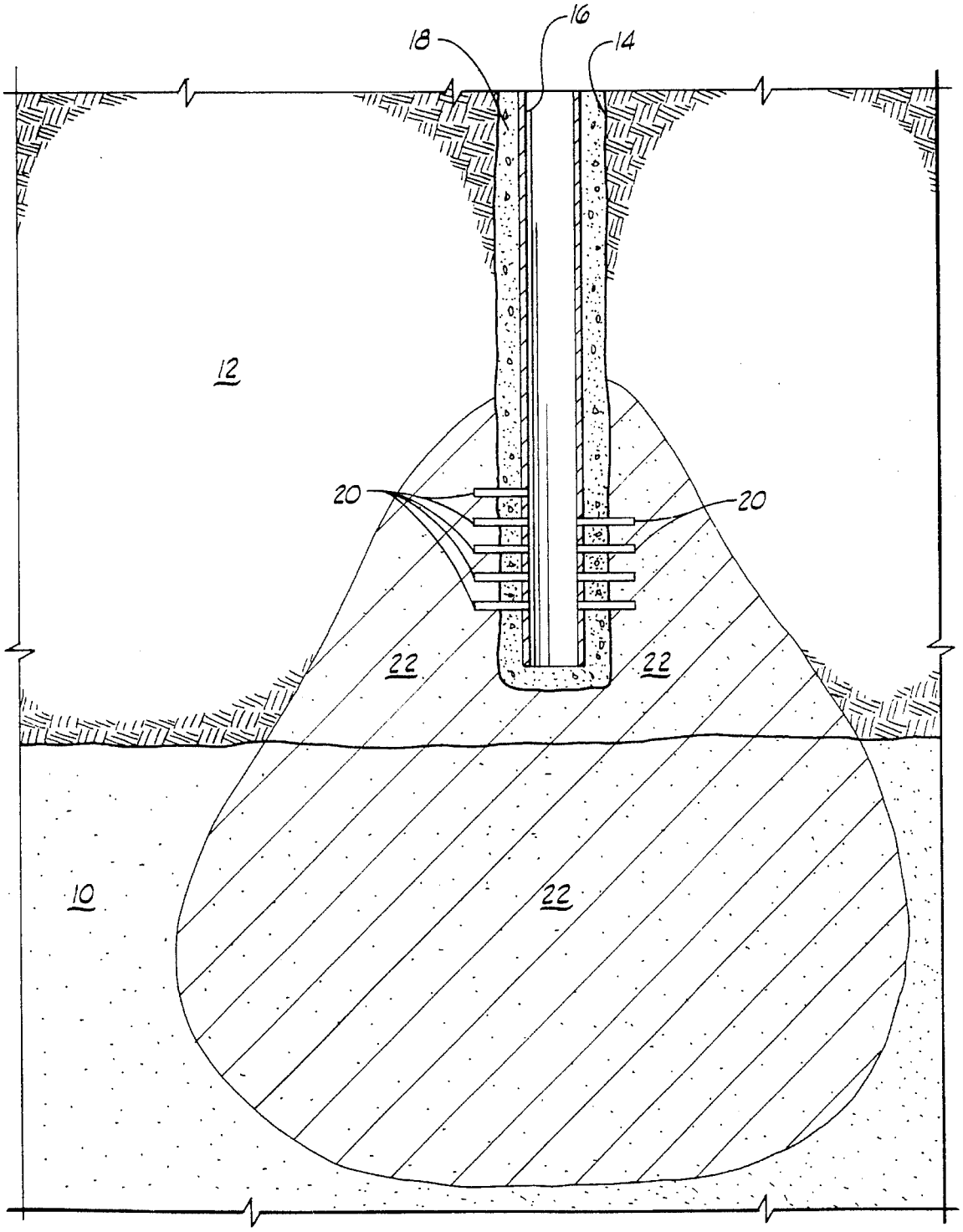
FIG. 1 is a schematic illustration of a subterranean poorly consolidated or otherwise unstable formation bounded on its upper surface by a consolidated formation which has a perforated cased and cemented vertical well bore drilled therein and a vertical fracture communicating the perforations and well bore with the poorly consolidated (or otherwise weak or unstable) formation.
Figure 2:
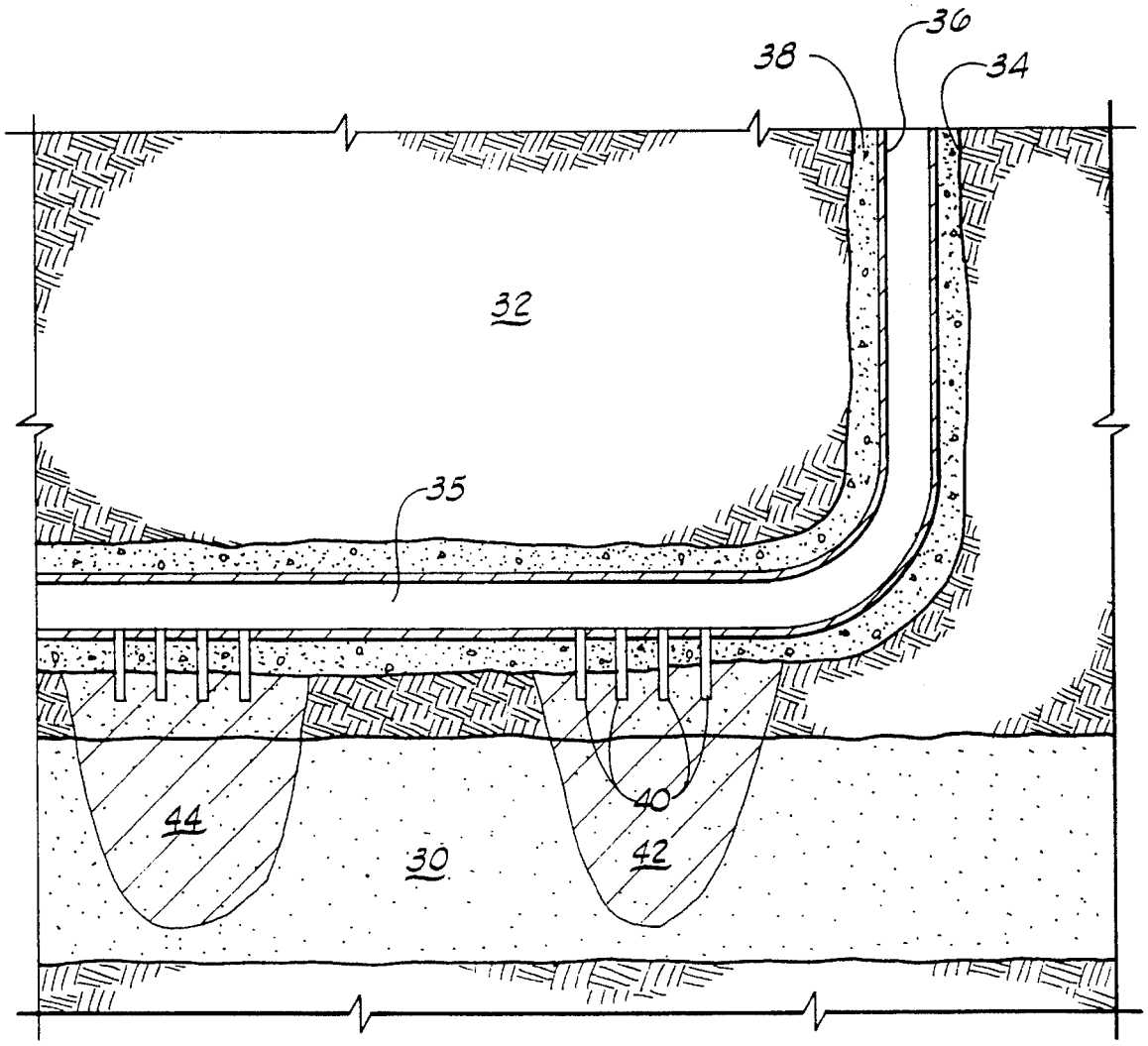
FIG. 2 is a schematic illustration of a poorly consolidated or otherwise unstable formation bounded on its upper surface by a consolidated formation which has a perforated cased and cemented horizontal well bore drilled therein and a pair of vertical fractures communicating the perforations and well bore with the poorly consolidated formation.
Figure 3:
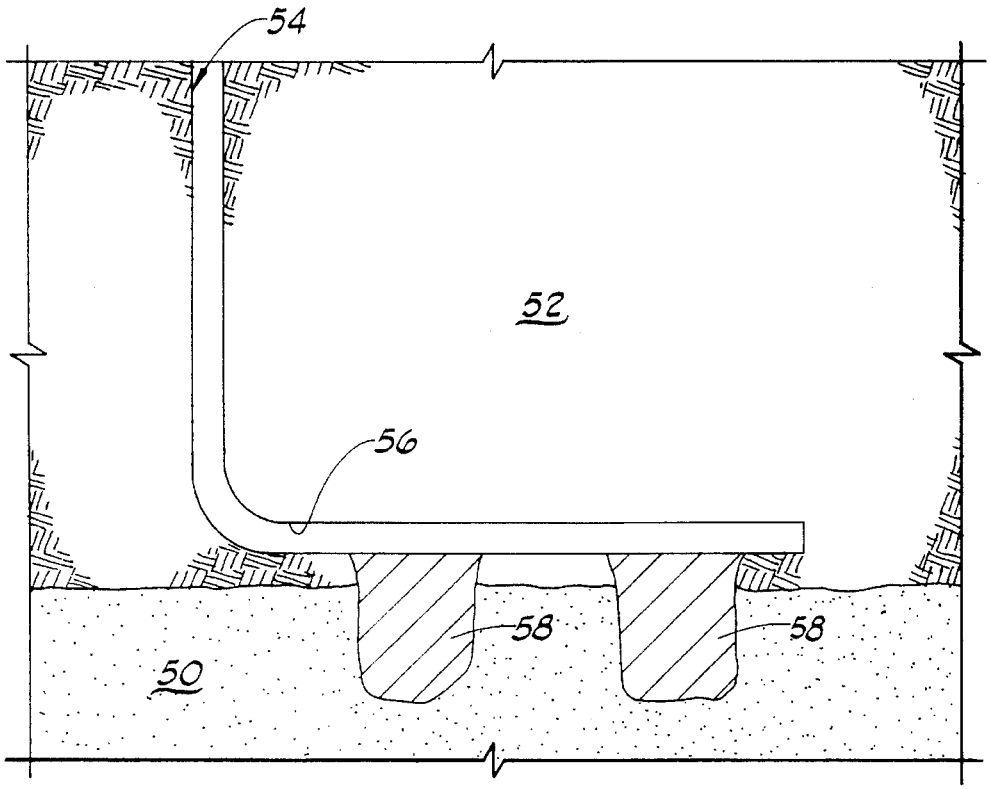
FIG. 3 is a schematic illustration of a poorly consolidated formation bounded on its upper surface by a consolidated formation which has an uncased horizontal well bore drilled therein and flow channels such as fluid jetted slots communicating the well bore with the poorly consolidated formation.
Figure 4:
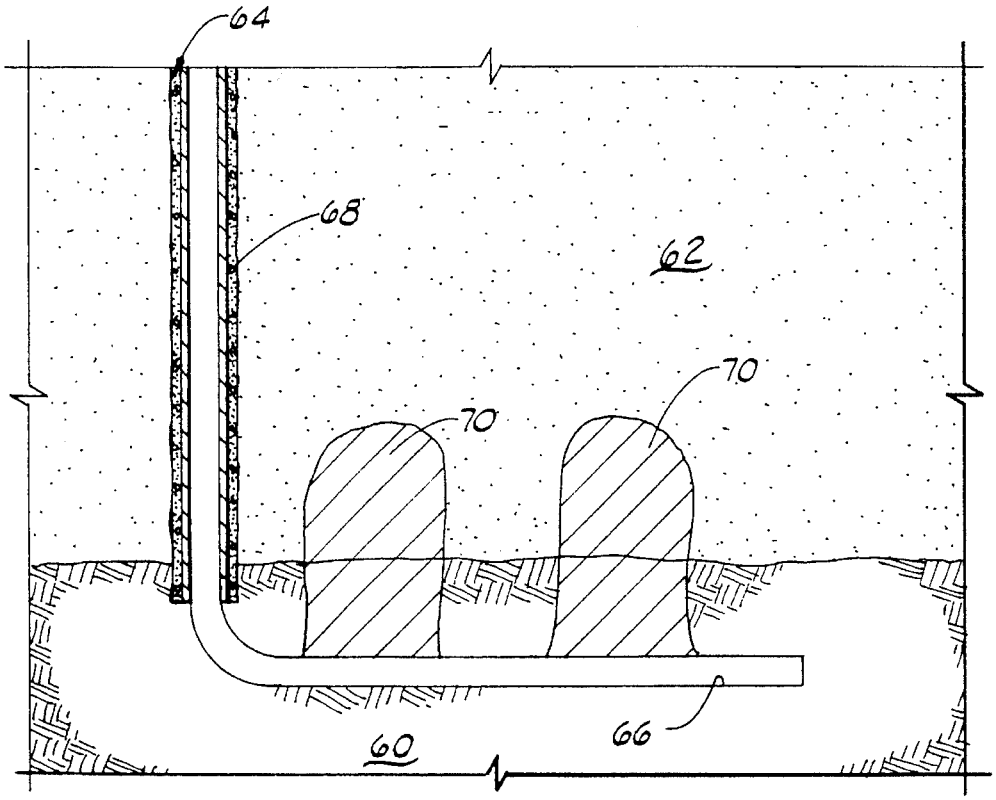
FIG. 4 is a schematic illustration of a poorly consolidated formation having a cased and cemented vertical well bore extending therethrough bounded on its lower surface by a consolidated formation having an uncased (as in FIG. 4) horizontal well bore drilled therein and a plurality of flow channels such as vertical hydraulic fractures or slots communicating the horizontal well bore with the poorly consolidated formation.

In carrying out the methods of the present invention, the first step is to drill a well bore into a boundary consolidated formation adjacent to the poorly consolidated or unstable formation to be completed. The well bore can be either vertical as shown in FIG. 1 or horizontal as shown in FIGS. 2–4. However, it is preferable that a horizontal well bore be drilled into the consolidated formation above or below the poorly consolidated or unstable formation for reasons which will be described further herein below.

Referring to FIG. 1, a poorly consolidated or unstable formation 10 is illustrated positioned below a consolidated formation 12. A vertical well bore 14 is drilled into the consolidated formation 12, close to but not into the poorly consolidated or unstable formation 10. This well bore could be completed in an open hole manner, but more preferably the well bore 14 is completed conventionally, that is, it contains a casing 16 surrounded by a cement sheath 18. Other known completion methods can also be used such as sliding sleeves, liner, etc.

After the casing 16 has been cemented in the well bore 14, an interval of the well bore adjacent to the poorly consolidated or unstable formation 10 is perforated. That is, a plurality of directionally oriented perforations 20 are formed in an about 1 to about 5 foot interval in the well bore 14 which extend through the casing 16 and the cement 18 and into the consolidated formation 12. The perforations are formed utilizing conventional perforation forming equipment and known orienting techniques.

The particular arrangement and alignment of the perforations 20 are such that when a hydraulic pressure is applied to the perforations from within the well bore 14, one or more fractures are formed in the consolidated formation 12 which can be extended into the poorly consolidated or unstable formation 10.

It is known that when fractures are created from a substantially vertical well bore in a formation, two vertical fracture wings are generally produced which extend from opposite sides of the well bore at right angles to the in-situ least principle stress in the formation. Stated another way, the fractures extend in the direction of the maximum horizontal stress in the formation. Thus, a knowledge of the direction of the maximum horizontal stress in the consolidated formation 12 is advantageous and can be determined by a number of well known methods. In one such method, the formation is subjected to fracturing before the well is cased by applying hydraulic pressure to the formation by way of the well bore. When a fracture forms, the maximum horizontal stress direction can be determined from the direction of the formed fracture using a direction oriented fracture impression packer, a direction oriented well bore television camera or other similar tool or oriented core sample. A preferred method of determining the maximum horizontal stress direction is disclosed in U.S. Pat. No. 4,529,036 to Daneshy, et al., issued Jul. 16, 1985, the entire disclosure of which is incorporated herein by reference.

In performing the method of the present invention utilizing the vertical well bore 14, the perforations 20 are preferably aligned, if possible, with the maximum horizontal stress in the formation 12 to intersect the poorly consolidated or unstable formation 10. The reason for such alignment is that the widest fractures having the least flow resistance are those formed in the direction of the maximum horizontal stress. Also, the perforations 20 are preferably positioned in a 180° phasing, i.e., whereby perforations extend from opposite sides of the well bore as shown in FIG. 1.

After the perforations 20 are formed, hydraulic pressure is applied to the perforations by pumping a fracturing fluid into the perforations and into the formation 12 at a rate and pressure such that the consolidated formation 12 fractures. As the hydraulic pressure is continued, a vertical fracture 22 is extended from the well bore 14 in opposite directions in alignment with the maximum horizontal stress in the consolidated formation 12. When the fracture 22 reaches the poorly consolidated or otherwise unstable formation 10, it is rapidly extended into the poorly consolidated or unstable formation 10 as illustrated in FIG. 1. The rapid extension of the fracture 22 into the poorly consolidated or unstable formation 10 diverts the energy of the fracturing fluid into the formation 10, and it stops growing into the consolidated formation 12.

Thus, the fracture 22 starts at the perforations 20 and progresses into the poorly consolidated or unstable formation 10. The directionally oriented perforations 20 provide an initiation point for application of the hydraulic pressure created by the introduction of fracturing fluid into the formation 12, and cause the fracture 22 to extend from the well bore 14 in the desired direction of maximum horizontal stress thereby minimizing fracture reorientation and the consequent restriction in the width of the formed fracture. Minimizing reorientation reduces the initial pressure that must be applied to achieve formation breakdown, reduces the pressure levels necessary to extend a created fracture, maximizes the fracture width achieved and produces smoother fracture faces which reduces friction on fluid flow.

In order to make the fracture 22 as conductive as possible to hydrocarbon fluids contained in the poorly consolidated or unstable formation 10, the fracture 22 is propped. That is, as the fracture 22 is extended in the consolidated formation 12 and into the poorly consolidated or unstable formation 10, a particulate material propping agent is carried into the fracture in the fracturing fluid and is deposited therein. Upon completion of the fracturing treatment, the propping agent remains in the created fracture thereby preventing it from closing and providing a highly permeable flow channel.

The fracturing fluid utilized to create the fractures in accordance with this invention can be any aqueous or non-aqueous fluid that does not adversely react with materials in the formations contacted thereby. Fracturing fluids commonly include additives and components such as gelling agents, crosslinking agents, gel breakers, surfactants, carbon dioxide, nitrogen and the like. The propping agent used in the fracturing fluid can be any conventional propping agent such as sand, sintered bauxite, ceramics and the like. The preferred propping agent for use in accordance with this invention is sand, and the sand or other propping agent utilized is preferably coated with a resin composition which subsequently hardens to consolidate the propping agent and prevent its movement with produced fluids.

The use of a resin composition coated propping agent to consolidate the propping agent after its deposit in a subterranean zone is described in U.S. Pat. No. 5,128,390 issued on Jul. 7, 1992, to Murphey, et al., and such patent is incorporated herein by reference.

A preferred fracturing fluid for use in accordance with the present invention is comprised of an aqueous gelled liquid having a hardenable resin composition coated propping agent, preferably sand, suspended therein. Upon being deposited in the fracture created with the fracturing fluid, the resin coated propping agent is consolidated into a hard permeable mass therein.

The use of this new completion method could also be followed by conventional methods such as gravel pack, slotted liners, or prepacked liners to help control flowback of the proppant from the fracture communicating with the poorly consolidated or unstable formation.

Referring now to FIG. 2, a poorly consolidated or unstable formation 30 is illustrated positioned below a consolidated boundary formation 32. A well bore 34 is drilled into the consolidated formation 32 which includes a horizontal portion 35 positioned above the poorly consolidated or unstable formation 30. The well bore 34 contains casing 36 surrounded by a cement sheath 38.

As will be understood by those skilled in the art, the portion 35 of the well bore 34 is referred to herein as a horizontal well bore even though it may not actually be positioned at 90° from vertical. For example, the well bore portion 35 may penetrate a formation at an angle greater or less than 90° from vertical (often referred to as a deviated well bore) which substantially parallels the direction of the bedding planes in the formation. Subterranean formations often include synclines and anticlines whereby the bedding planes are not 90° from vertical. As used herein, the term "horizontal well bore" means a well bore or portion thereof which penetrates a formation at an angle of from about 60° to about 120° from vertical.

In one preferred embodiment, a plurality of directionally oriented perforations 40 are produced in the lower side of the horizontal portion 35 of the well bore 34. The perforations 40 are aligned in a downward direction so that when a hydraulic pressure is applied to the perforations 40, a downwardly extending fracture 42 is formed. Because of the vertical over-burden induced stress in the consolidated formation 32, the fracture 42 may preferentially extend substantially vertically downward from the horizontal well bore 34. The angle at which the fracture 42 takes with respect to the axis of the horizontal portion 35 of the well bore 34 depends on the direction of the maximum horizontal stress in the consolidated formation 32. For example, if the maximum horizontal stress in the formation 32 parallels the axis of the well bore portion 35, the fracture 42 will be aligned with the axis of the well bore portion 35 as illustrated in FIG. 2. On the other hand, if the maximum horizontal stress direction is transverse to the axis of the horizontal well bore portion 35, the fracture 42 will be transverse thereto. If the maximum horizontal stress is at some angle substantially more than a few degrees but substantially less than ninety degrees, the induced fracture(s) may intersect the well bore at approximately the same angle as this stress plane.

After the downwardly aligned perforations 40 are produced, hydraulic pressure is applied to the perforations by pumping a fracturing fluid thereunto and into the consolidated formation 32. The fracturing fluid is pumped into the well bore at a rate and pressure such that the consolidated formation 32 fractures. As the hydraulic pressure from the fracturing fluid is continued, the fracture 42 extends below the horizontal well bore portion 35 into the poorly consolidated or unstable formation 30 as shown in FIG. 2. As described above in connection with the fracture 22, a propping agent, preferably sand coated with a hardenable resin composition, is suspended in the fracturing fluid whereby it is carried into, deposited and formed into a consolidated permeable mass therein.

After forming the propped fracture 42, a second propped fracture 44 and other propped fractures (not shown) can be formed along the length of the horizontal portion 35 of the well bore 34 to provide additional flow channels in the poorly consolidated or unstable formation 30 through which hydrocarbon fluids can be produced without also producing sand.

When the consolidated formation is made up of rock having excellent mechanical properties such that the stress concentrations produced as a result of drilling a well bore into the formation and fracturing the formation do not cause the formation to break down, the well bore can be open hole completed in the consolidated formation as illustrated in FIG. 3. That is, referring to FIG. 3, a poorly consolidated or unstable formation 50 is positioned below a consolidated formation 52. A well bore 54 is drilled into the consolidated formation 52 which includes a horizontal portion 56 positioned above and adjacent to the poorly consolidated or unstable formation 50. When the consolidated formation 52 is formed of non-carbonate rock having excellent mechanical properties, flow channels 58 extending from the horizontal portion 56 of the well bore 54 into the poorly consolidated or unstable formation 50 are preferably formed by the fracturing techniques described above.

The methods of the present invention can also be utilized in situations where the consolidated formation is positioned below a poorly consolidated or unstable hydrocarbon producing formation. That is, referring to FIG. 4, when a consolidated formation 60 is positioned below a poorly consolidated or unstable producing formation 62, a well bore 64 is drilled through the poorly consolidated or unstable formation 62 into the consolidated formation 60. As shown, the portion 66 of the well bore 64 in the consolidated formation 60 is preferably horizontal and is positioned relatively close to the poorly consolidated or unstable formation 62. The vertical portion 68 of the well bore 64 which extends through the poorly consolidated or unstable formation 62 is preferably cased and cemented as shown in order to prevent cave-ins and the like as a result of the instability of the poorly consolidated or unstable formation. Flow channels 70 are formed from the horizontal portion 66 of the well bore 64 in the consolidated formation 60 into the poorly consolidated or unstable formation 62.

As mentioned, various other techniques of forming or creating one or more flow channels in the consolidated formation which communicate with the well bore and extend into the poorly consolidated or unstable formation can be utilized in accordance with the present invention. The particular technique utilized depends upon various factors including the makeup of the consolidated formation and the proximity of the well bore in the consolidated formation to the poorly consolidated or unstable formation.

If the consolidated formation 52 is formed of carbonate rock, the flow channels 58 can be formed utilizing a fracture acidizing technique. Fracture acidizing is a well known stimulation procedure used in low permeability acid soluble carbonate rock formations. A fracture acidizing procedure generally comprises hydraulically fracturing the carbonate rock formation at above fracturing pressure using an acid which dissolves the fracture faces in such an uneven manner that when the fractures are closed and the formation is produced, flow channels are provided through which hydrocarbons contained in the formation more readily flow to the well bore.

A preferred method of fracture acidizing is described in U.S. Pat. No. 5,238,068 issued on Aug. 24, 1993, to Fredrickson which is assigned to the assignee of this present invention. In accordance with that method, one or more fractures are created in a subterranean formation, the fractures are allowed to close and acid is injected into and through the closed fractures so that flow channels are formed therein. The steps of extending the fractures, causing the fractures to close and forming flow channels in the extended portions are repeated until fractures having flow channels formed therein extend desired distances outwardly from the well bore. By forming the flow channels while the fractures are closed, the fracture faces are not over etched or softened by the acid whereby they crush against each other when closed and obliterate the flow channels formed.

A variety of organic or inorganic acids dispersed or dissolved in aqueous or hydrocarbon carrier liquids can be utilized for performing fracture acidizing procedures. Generally, aqueous acid solutions are preferred. Preferred acids for treating carbonate formations are hydrochloric acid, acetic acid, formic acid and mixtures of such acids. The acids utilized may be retarded for slowing the reaction rates thereof with formation materials using heretofore known acid retarding agents. The acids may also contain conventional corrosion inhibitors to protect metal surfaces contacted thereby and surfactants to prevent emulsion problems. A generally preferred acid solution for use in accordance with the present invention is a 5 to 30% by weight aqueous hydrochloric acid solution.

Another method of forming flow channels from a well bore in a consolidated formation into an adjacent poorly consolidated or unstable formation in accordance with this invention involves cutting slots extending from the well bore utilizing fluid jetting. Fluid jetting, often referred to as "HYDRA-JETTING", is a well known technique which can be utilized for perforating or cutting slots in casing, cement and surrounding formation. A variety of "HYDRA-JET" tools are available which include different sizes and arrangements of nozzles whereby a pressurized fluid, often containing an abrasive material, can be pumped from the surface through the nozzles to produce flow channels extending from a well bore. Fluid jetting is preferably utilized in accordance with the present invention in situations where the well bore in the consolidated formation is relatively close to the poorly consolidated or unstable formation.

Examples of other techniques that can be used include over-balanced and under-balanced perforation techniques using shaped charges or bullet charges. Over-balanced perforation involves maintaining a fluid pressure in the well bore which is greater than the formation pressure so that when the perforations are formed, the debris generated is forced into the formation. In under-balanced perforation, a pressure in the well bore lower than the formation pressure is produced so that when the perforations are formed, the debris generated is forced into the well bore and upwardly therein to the surface.

As will now be understood, various techniques can be utilized for forming one or more flow channels from a well bore drilled into a consolidated formation into an adjacent poorly consolidated or unstable producing formation in accordance with the present invention. In whatever technique is utilized to form the flow channels, they are preferably packed with a particulate material such as sand and the particulate material consolidated therein in order to prevent formation fines from migrating into the well bore with produced fluids. Two or more techniques such as fracturing and fluid jetting can be utilized to provide flow channels from a single well bore to a poorly consolidated or unstable producing formation.

As will also be understood, instead of removing formation material from a poorly consolidated or unstable formation by forming a well bore therein which causes the breakdown of the formation and the production of sand therefrom, the methods of the present invention add material, i.e., particulate material which is preferably consolidated, to a poorly consolidated or unstable formation which increases the overall formation resistance to formation breakdown, etc. Further, the creation of a plurality of conductive fractures in a poorly consolidated or unstable formation through which formation fluids are produced converts high pressure draw-down radial flow which occurs in a formation penetrated by a well bore to low pressure draw-down linear flow. This low pressure draw-down linear flow through one or more propped or packed flow channels in a poorly consolidated or unstable formation also helps prevent the breakdown of the formation and the consequent sand production.

The completion methods of this invention are particularly advantageous when carried out in formations where water coning would occur if the formation fluids were produced through a vertical well bore penetrating the formation.

Thus, the present invention is well adapted to carry out the objects and attain the ends and advantages mentioned as well as those which are inherent therein. While numerous changes in the construction and arrangement of parts may be made by those skilled in the art, such changes are encompassed within the spirit of this invention as defined by the appended claims.

What is claimed is:

1. A method of completing a well in a desired producing formation which has stability problems and which is bounded on at least one side by a consolidated formation which does not have well bore stability problems comprising the steps of:

(a) drilling a well bore into said consolidated formation adjacent to said desired producing formation;

(b) creating one or more flow channels in said bounding formation which communicates with said well bore and extends into said desired producing formation, wherein said flow channel is created by fluid jetting at least one hole or slot from said well bore into said desired producing formation; and (c) producing fluids from said desired producing formation into said well bore by way of said flow channel.

2. The method of claim 1 wherein said flow channel is packed with a propping agent or gravel pack material.

3. The method of claim 1 wherein said flow channel is packed with a consolidated resin coated particulate material.

4. The method of claim 3 wherein said particulate material is sand.

5. The method of claim 1 wherein said well bore in said consolidated formation is a substantially vertical well bore.

6. The method of claim 1 wherein said well bore in said consolidated formation is a horizontal well bore.

7. The method of claim 1 further comprising the step of creating a flow channel by forming a fracture from said well bore into said desired producing formation.

8. The method of claim 7 wherein said fracture is packed with propping agents or gravel pack materials.

9. The method of claim 7 wherein said fracture is enhanced by contacting the formation surfaces within said fracture with an acid.

10. A method of completing a well in a desired producing formation which has stability problems and which is bounded on at least one side by a consolidated formation which does not have well bore stability problems comprising the steps of:

(a) drilling a horizontal well bore into said consolidated formation adjacent to said producing formation;

(b) creating a propped fracture in said consolidated formation which communicates with said well bore and extends into said producing formation; and (c) producing fluids from said producing formation into said well bore by way of said propped fracture.

11. The method of claim 10 wherein said fracture is propped with a consolidated resin coated particulate material.

12. The method of claim 11 wherein said particulate material is sand.

13. The method of claim 10 wherein said horizontal well bore is positioned above said desired producing formation.

14. The method of claim 10 wherein said horizontal well bore is positioned below said desired producing formation.

15. The method of claim 10 further comprising the step of fluid jetting at least one hole or slot from said well bore into said producing formation.

16. The method of claim 10 wherein step (b) includes:

creating a plurality of directionally oriented perforations in said well bore arranged to produce said fracture intersecting said producing formation when hydraulic pressure is applied thereto; and applying hydraulic pressure to said perforations in an amount sufficient to form said fracture in said consolidated formation and extend said fracture into said producing formation.

17. A method of completing a well in a desired producing formation which has stability problems and which is bounded on at least one side by a consolidated formation which does not have well bore stability problems comprising the steps of:

(a) drilling a horizontal well bore into said consolidated formation adjacent to said producing formation;

(b) creating a plurality of directionally oriented perforations in said well bore arranged to produce a fracture intersecting said producing formation;

(c) applying hydraulic pressure to said perforations with a particulate material containing fracturing fluid in an amount sufficient to create said fracture in said consolidated formation, to extend said fracture from said well bore into said producing formation and to prop said fracture with said particulate material; and (d) producing fluids from said producing formation into said well bore by way of said propped fracture.

18. The method of claim 17 wherein said horizontal well bore is positioned above said producing formation.

19. The method of claim 17 wherein said horizontal well bore is positioned below said producing formation.

20. The method of claim 17 further comprising the step of fluid jetting at least one hole or slot from said well bore into said producing formation.

* * * * *